United States Patent [19]

Sasaki et al.

[11] 4,270,199

[45] May 26, 1981

[54] SWITCHING MECHANISM FOR ELECTRONIC WRISTWATCH

[75] Inventors: Takehiko Sasaki, Yamatokoriyama; Hidetoshi Maeda, Tenri, both of Japan

[73] Assignee: Sharp Kabushiki Kaisha, Osaka, Japan

[21] Appl. No.: 864,802

[22] Filed: Dec. 27, 1977

Related U.S. Application Data

[63] Continuation of Ser. No. 575,731, May 8, 1975, abandoned.

[30] Foreign Application Priority Data

May 8, 1974 [JP] Japan ..... 49-51456
Jul. 4, 1974 [JP] Japan ..... 49-77029

[51] Int. Cl.[3] ..... G04B 19/00

[52] U.S. Cl. ..... 368/224; 368/69; 368/70

[58] Field of Search ..... 58/23 R, 23 BA, 50 R, 58/85.5, 23 A; 200/DIG. 2, DIG. 1, 52 R; 340/365 R, 365 C; 84/DIG. 7; 307/116, 304; 368/224, 69, 70

[56] References Cited

U.S. PATENT DOCUMENTS

| | | | |
|---|---|---|---|
| 2,340,213 | 1/1944 | Ellsworth | 84/DIG. 7 X |
| 2,873,637 | 2/1959 | Herold | 84/DIG. 7 X |
| 3,081,594 | 3/1963 | Atkins et al. | 58/50 R |
| 3,670,322 | 6/1972 | Mallebrein | 340/365 R X |
| 3,705,424 | 12/1972 | Harvey, Jr. | 340/365 R |
| 3,757,322 | 9/1973 | Barkan et al. | 340/365 C |
| 3,823,546 | 7/1974 | Gortz et al. | 58/23 R |
| 3,823,550 | 7/1974 | Bergey | 58/50 R |
| 3,911,664 | 10/1975 | Haber | 58/23 R |
| 3,934,159 | 1/1976 | Nomiya et al. | 307/304 |
| 3,944,843 | 3/1976 | Vaz Martins | 307/116 |

*Primary Examiner*—Ulysses Weldon

*Attorney, Agent, or Firm*—Birch, Stewart, Kolasch and Birch

[57] ABSTRACT

A thin-film transparent electrode is provided on the front glass of an electronic wristwatch to form a part of a switching mechanism cooperation with a metal frame provided at the back of the wristwatch. The metal frame is maintained in contact with the operator's wrist in an operative condition. When the operator touches the thin-film transparent electrode, the switching mechanism in its ON condition provides a signal for controlling an operation mode of the electronic wristwatch, for example, a display condition.

7 Claims, 7 Drawing Figures

SWITCHING MECHANISM FOR ELECTRONIC WRISTWATCH

This application is a continuation of copending application Ser. No. 575,731, filed on May 8, 1975, now abandoned.

BACKGROUND AND SUMMARY OF THE INVENTION

The present invention relates to an electronic wristwatch and more particularly relates to a switch mechanism for an electronic wristwatch for controlling an operation mode of the watch.

The electronic wristwatch usually includes a digital display unit made of, for example, a liquid crystal display unit or light-emitting diodes. The light-emitting diodes consume considerably large power, though it is not preferable for an electronic wristwatch. In order to avoid unnecessary power dissipation on the light-emitting diodes, an effective display system has been proposed wherein the display is enabled only at a desired time by closing a switch of which a knob is provided on a frame of the wristwatch. It was difficult to handle the above-mentioned switch of the prior art, since the knob was very small and the wristwatch can not always be tightly fixed to the operator's wrist. The vacuum-tight construction was complicated because of provision of such switch knob.

Accordingly, an object of the present invention is to provide a novel switch mechanism for an electronic wristwatch for controlling an operation mode of the electronic wristwatch.

Another object of the present invention is to provide a network for detecting the closing of a switch mechanism of an electronic wristwatch.

Other objects and further scope of applicability of the present invention will become apparent from the detailed description give hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to the present invention, a thin-film transparent electrode is provided on the front window of an electronic wristwatch through the use of vacuum evaporation technology. A metal frame provided at the back of the wristwatch is kept in contact with the operator's wrist in an operative condition. A complementary metal oxide semiconductor inverter circuit is provided to detect a resistance value between the thin-film transparent electrode and the metal frame. When the operator touches the thin-film transparent electrode, an electric current flow is created through the operator. The reduction of the resistance value is detected by the complementary metal oxide semiconductor inverter circuit, which then provides a signal for controlling an operation mode of the electronic wristwatch, for example, a display condition.

BRIEF DESCRIPTION OF THE DRAWINGS

The present invention will become more fully understood from the detailed description given hereinbelow and the accompanying drawings which are given by way of illustration only, and thus do not limit of the present invention and wherein.

DESCRIPTION OF THE PREFERRED EMBODIMENTS

Figure 1:
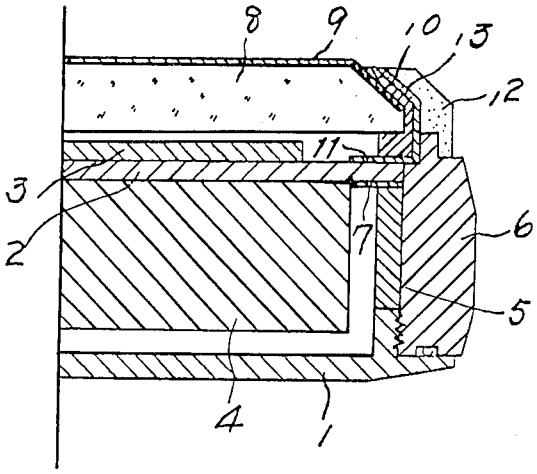
FIG. 1 is a cross-sectional view of an electronic wristwatch of the present invention.

Referring now to FIG. 1, there is illustrated an embodiment of an electronic wristwatch of the present invention, a metal frame 1 is provided at the back of the electronic wristwatch, which is kept in contact with the operator's wrist in its operative condition. The metal frame 1 acts as an electrode for a switching mechanism. A substrate 2 made of ceramics or resin is provided for supporting display elements 3 made of light-emitting diodes on its upper surface and movements 4 necessary for performing the counting operation of the watch on its rear surface. Electrical connection between the metal frame 1 and the movements 4 is achieved through an internal frame 5 made of metal, a casing 6 made of metal and a metal leaf 7 attached to the rear surface of the substrate 2.

A front glass 8 is provided above the display elements 3. The upper surface of the front glass 8 is coated with a thin-film transparent electrode 9 through the use of the vacuum evaporation technology, thin-film transparent electrode 9 acting as another electrode for the switching mechanism. The thin-film transparent electrode 9 is usually made of indium oxide or tin oxide and is tightly attached to the glass 8 and can not be easily peeled off. The thin-film transparent electrode 9 is electrically connected with the movements 4 through a conductive rubber frame 10, which also acts as an water-proof packing, and a metal leaf 11. An insulating rubber frame 13 is provided for electrically insulating the thin-film transparent electrode 9 and the conductive rubber frame 10 from a glass supporter 12 made of metal and the casing 6 made of metal. The conductive rubber frame 10 and the insulating rubber frame 13 can be constructed in a single body, thereby facilitating the fabrication of the electronic wristwatch.

Figure 2:
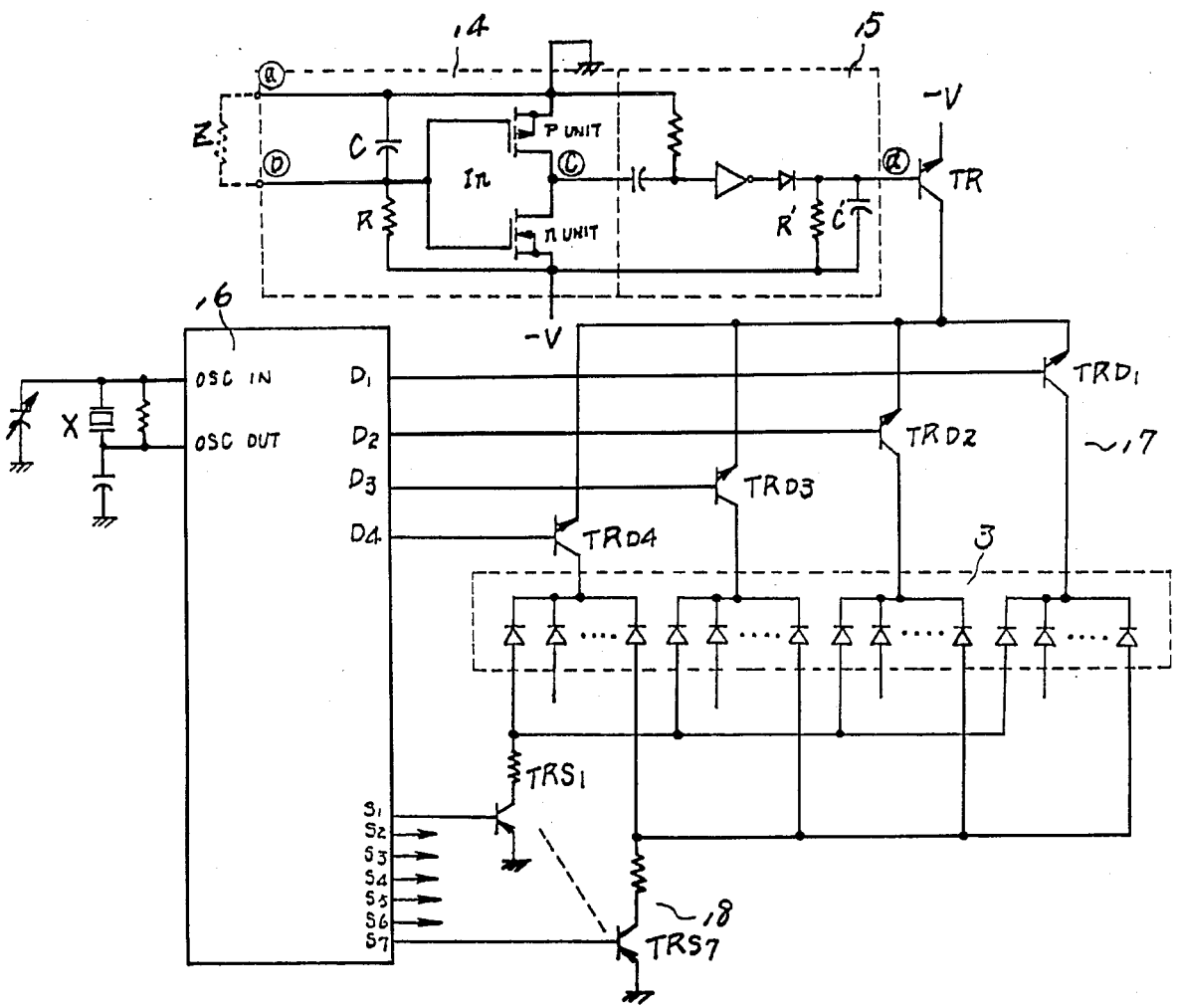
FIG. 2 is a circuit diagram of the electronic wristwatch of the present invention.
Figure 6:
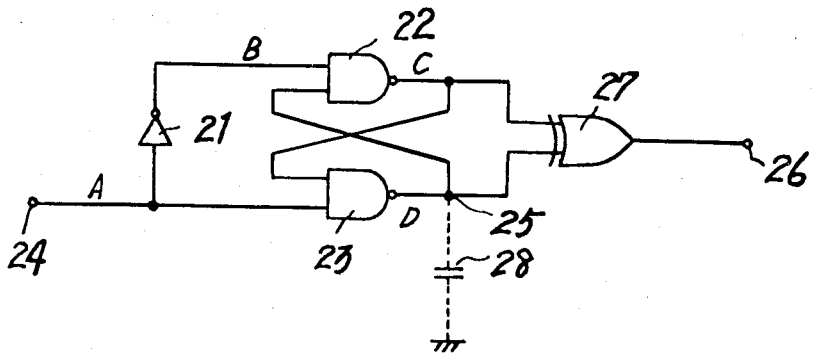
FIG. 6 is a circuit diagram of another embodiment of a switching circuit of the present invention.
Figure 7:
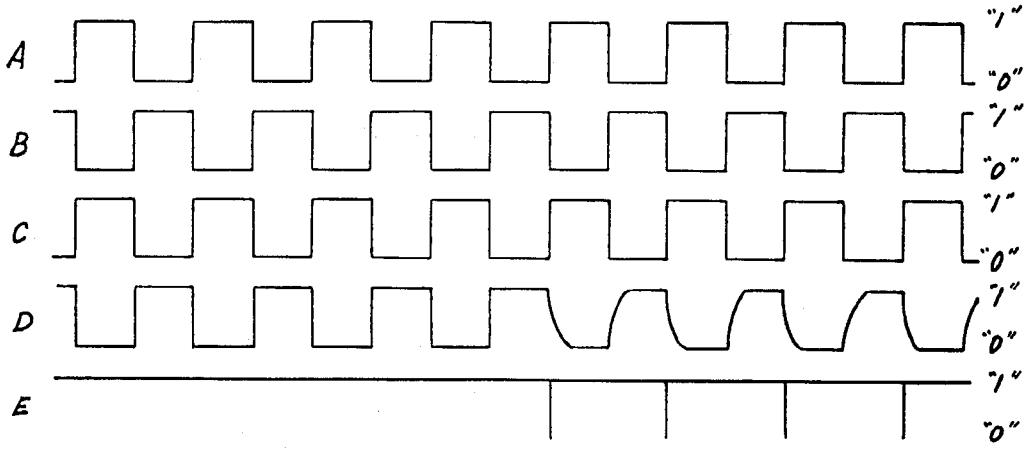
FIG. 7 is a time chart for the purpose of explanation of the switching circuit of FIG. 6.

FIG. 2 shows a circuit construction of the electronic wristwatch of the present invention including the display elements 3 made of the light-emitting diodes, the movements 4, the metal rear frame 1 and the thin-film transparent electrode 9.

In FIG. 2 a point "a" corresponds to the metal rear frame 1 and a point ⓑ corresponds to the thin-film transparent electrode 9, respectively. A switching circuit 14 comprises a C-MOS inverter In which has two input terminals ⓐ and ⓑ associated with the metal rear frame 1 and the thin-film transparent electrode 9, respectively.

When the electric circuit between the points ⓐ and ⓑ is in the open condition, the gate input of the C-MOS inverter In is connected with a negative voltage source −V though a resistor R of high resistance.

The gate input can be maintained at a low level (logical value "0") even though the electrical path is shunted through the high resistance R (in principle $R \leqq 10^{12}\Omega$), since the input impedance of the C-MOS inverter In is usually arond $10^{12}\Omega$. Accordingly, the gate input of the C-MOS inverter In is usually maintained at the low level (logical value "0") by the high resistance R.

When the operator touches the thin-film transparent electrode 9, the points ⓐ and ⓑ are connected each other through a resistance Z which is caused by the operator's body. The gate input voltage $V_G$ is identical with the voltage value divided by the resistances Z and R, and can be expressed as follows:

$$V_G = -\frac{R}{Z+R} V \quad (1)$$

When the gate input voltage $V_G$ exceeds the threshold voltage $V_T$ of the C-MOS inverter In, the gate input changes from its low level (logical value "0") to its high level (logical value "1"). It will be noted that the condition of the inversion is as follows:

$$V_G > V_T \quad (2)$$

The threshold voltage $V_T$ of the C-MOS inverter In unavoidably varies depending upon the individual condition. Now assume that;

$$V_T = -0.7\ V \quad (3)$$

The following relation can be derived from the expressions (1), (2) and (3).

$$\frac{R}{Z-R} > 0.7 \quad (4)$$

or $$R > 2.3\% \quad (5)$$

When the input impedance of the C-MOS inverter In is represented as Zin, the condition of the inversion of the gate input from its high level (logical value "1") to its low level (logical value "0") can be expressed as follows:

$$V_G = -\frac{R}{Zin+R} V \quad (6)$$

$$V_T > V_G \quad (7)$$

$$V_T = -0.3V \quad (8)$$

Therefore, the following expression can be derived from the expressions (6), (7) and (8).

$$\frac{R}{Zin+R} < 0.3 \quad (9)$$

or $$R < 0.4Zin \quad (10)$$

When the resistance value Z of the operator's body is $5\times10^6\Omega$, the resistance value R in the expression (5) can be expressed as follows:

$$R > 2.3 \times 5 \times 10^6 = 11.5 \times 10^6 \quad (11)$$

When the input impedance Zin is $10^{12}\Omega$, the resistance value R in the expression (10) can be expressed as follows:

$$R < 4\times10^{11} \quad (12)$$

It will be clear from expressions (11) and (12) that the switching mechanism can be performed by the C-MOS inverter In when the resistance value R of the high resistance is selected around $20\times10^6\Omega$.

A capacitor C cooperates with the resistor R within the switching circuit 14 to form a low-pass filter, thereby preventing the entrance of the induced noise.

An inverter output from a point ⓒ of the switching circuit 14 is introduced into a mono-stable mutivibrator 15. The mono-stable multivibrator 15 is triggered at the trailing edge of the inverter output and the operation period thereof is decided by a time constant determined by a resistor R' and a capacitor O'. The mono-stable multivibrator 15 provides an output signal at a point ⓓ for the base electrode of a transistor TR which controls a voltage supply for the display elements 3 made of the light-emitting diodes. A main circuit 16 can be of a conventional construction and can be made of, for example, a C-MOS LSI comprising a generation circuit, a divider, a counter and a decoder. An input terminal OSCIN and an output terminal OSCOUT of the generation circuit in the main circuit 16 are connected with the both ends of a quartz-crystal oscillator X, respectively. The generation circuit, the divider, the counter and the decoder can be of conventional constructions and hence the detailed circuit constructions thereof have been omitted from this description for the purpose of simplicity. Digit selection terminals $D_1$–$D_4$ and segment selection terminals $S_1$–$S_7$ of the main circuit 16 are connected with respective driver circuits 17 and 18. The driver circuit 17 comprises transistors $TRD_1$–$TRD_4$ of which the base electrodes are connected to receive the respective output signals from the digit selection terminals $D_1$–$D_4$. The driver circuit 18 comprises transistors $TRS_1$–$TRS_7$ of which the base electrodes are connected with the segment selection terminals $S_1$–$S_7$, respectively. The driver circuits 17 and 18 can be incorporated into the LSI comprising the main circuit 16. Moreover, the LSI also can incorporate the switching circuit 14 and the mono-stable multivibrator 15 therein.

Figure 3:
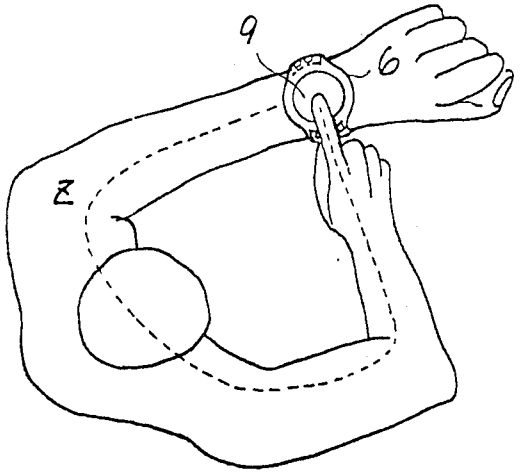
FIG. 3 is a schematic view for the purpose of explanation of the operation mode of the electronic wristwatch of the present invention.

FIG. 3 shows an operation mode of the electronic wristwatch when the operator touches the thin-film transparent electrode 9 provided on the front glass of the electronic wristwatch which is fixed to the operator's wrist. The electric current flow is created through the operator's body as shown by dotted lines in FIG. 3. The resistor Z is connected between the points ⓐ and ⓑ in the circuit of FIG. 2 when the operator touches the thin-film transparent electrode 9. The resistance value of the resistor Z is about $5\times10^6\Omega$ at its maximum, whereas the resistor R in the switching circuit 14 is selected at $20\times10^6\Omega$.

Figure 4:
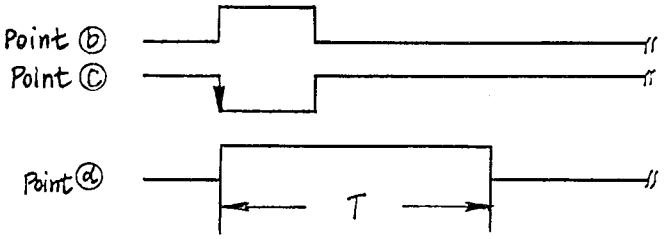
FIGS. 4 and 5 are time charts showing waveforms occurring within the circuit of FIG. 2.

When the resistance Z caused by the operator's body is inserted between the points ⓐ and ⓑ, the gate input of the inverter In changes from its low level (logical value "0") to its high level (logical value "1") as shown in a time chart of FIG. 4, point ⓑ. The inversion of the gate input of the inverter In can be referred to as a display indication signal. The display indication signal changes the inverter output from its high level (logical value "1") to its low level (logical value "0") as shown in FIG. 4 point ⓒ. The trailing edge of the signal at the point ⓒ, which is inverted from its high level to its low level upon receiving the display indication signal, triggers the mono-stable multivibrator 15. The output signal at the point ⓓ of the mono-stable multivibrator 15 is inverted from its low level (logical value "0") to its high level (logical value "1"), and then the high level is maintained during a predetermined time period T decided by the time constant determined by the resistor R' and the capacitor C' as shown in FIG. 4 point ⓓ .

When the point ⓓ is at the high level, the transistor TR is ON and hence the display elements 3 made of the light-emitting diodes are supplied with the negative power voltage −V via the transistors $TRD_1$–$TRD_4$ and $TRS_1$–$TRS_7$, which are controlled by the output signals from the digit selection terminals $D_1$–$D_4$ and the segment selection terminals $S_1$–$S_7$ of the main circuit 16, whereby the information corresponding to the current time is displayed on the display elements 3. The display is maintained during the time period T determined by the resistor R' and the capacitor C', thereby securing an accurate reading.

When the points ⓐ and ⓑ are erroneously shunted for a long period through a material except the operator's body, the unnecessary power dissipation on the display elements 3 can be avoided in a following manner.

Figure 5:
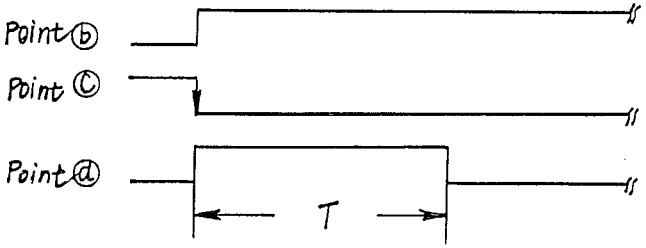

Even when the point ⓑ is maintained at the high level for a long period upon shunting the points ⓐ and ⓑ as shown in a time chart of FIG. 5 point ⓑ , the trailing edge of the signal at the point ⓒ appears only once as shown in FIG. 5 point ⓒ . Therefore, the following mono-stable multivibrator 15 is triggered only once. The output signal at the point ⓓ is maintained at its high level during the predetermined time period T as shown in FIG. 5 point ⓓ . The display elements 3 are enabled only during the predetermined time period T, and therefore, the unnecessary power dissipation on the display elements 3 is avoided.

The mono-stable multivibrator 15 can be avoided when the display can be easily read by the operator without being disturbed by the operator's hand which touches the thin-film transparent electrode 9. In this case the display is carried out during the time period when the operator touches the thin-film transparent electrode 9. The mono-stable multivibrator 15 can be alternatively be constructed to be triggered at the leading edge of the signal at the point ⓒ , whereby the display is carried out during a predetermined time period after the operator removes his hand from the thin-film transparent electrode 9.

In the foregoing embodiment the switching mechanism controls the power supply for the display elements made of the light-emitting diodes. When the display unit is made of the liquid-crystal display unit, the present switching mechanism can be applied to control a lamp for irradiating the liquid-crystal display unit at night in order to facilitate the reading operation. The present switching mechanism can also be applied to control the changing of the display information between, for example, hours and minutes, and dates.

What is claimed is:

1. A touch-sensitive electronic switching circuit for an electronic wristwatch comprising:

a C-MOS inverter circuit having a gate terminal and two power supply terminals;

a power source connected across said power supply terminals;

resistance means connected between said gate terminal and one of said supply terminals for maintaining the input level at said gate at approximately the same potential level of said one supply terminal;

a first touch-sensitive electrode connected to the other said power supply terminal;

another touch-sensitive electrode connected to said gate terminal;

wherein said another touch-sensitive electrode comprises a conductive watch casing for engaging the body skin of a wearer, said casing being conductively connected to said gate terminal;

wherein said casing includes a crystal isolated from the body skin of a wearer; and wherein said first touch-sensitive electrode comprises a transparent conductive coating on said crystal electrically isolated from said conductive casing and selectively connected thereto through the body resistance of a wearer by engagement with the skin of said wearer, thereby dividing the potential of said one supply terminal through said body resistance and said resistance means and applying said divided potential to said gate terminal.

2. The invention defined in claim 1, wherein said resistance means has a value on the order of $20\times10^6$ ohms and is approximately four times as great as the maximum anticipated value of said human body resistor.

3. A touch sensitive electronic switching circuit for an electronic wristwatch comprising:

a C-MOS inverter circuit having a gate terminal and two power supply terminals;

a power source connected across said power supply terminals;

resistance means connected between said gate terminal and one of said supply terminals for maintaining the input level at said gate at approximately the same potential level of said one supply terminal;

touch-sensitive electrode means for connecting said gate terminal with said other power supply terminal through a human body resistor to reduce said input level at said gate terminal;

said C-MOS inverter means including an output terminal; and mono-stable multivibrator means interconnected with said output terminal of said C-MOS inverter means to provide a display control output signal in response to said reduction in said input level at said gate terminals;

wherein said touch-sensitive electrode means comprises:

a first electrode comprising a conductive watch casing for engaging the body skin of a wearer and conductively connected to said gate terminal;

said casing including a crystal isolated from the body skin of a wearer; and a second electrode comprising a transparent conductive coating on said crystal electrically isolated from said conductive casing and selectively connected thereto through the body resistance of a wearer by engagement with the skin of said wearer.

4. The invention defined in claim 3 wherein said resistance means has a value on the order of $20\times10^6$ ohms and is approximately four times as great as the maximum anticipated value of said human body resistor.

5. A touch-sensitive electronic switching circuit for an electronic wristwatch comprising:

a C-MOS inverter circuit having a gate terminal and two power supply terminals;

a power source connected across said power supply terminal;

low pass filter means for precluding the entrance of induced noise into said C-MOS inverter circuit including resistance means connected between said gate terminal and one of said supply terminals for maintaining the input level at said gate at approximately the same potential level of said one supply terminal and a filter capacitor connected between said other power supply terminal and said gate terminal; and touch sensitive electrode means for connecting said gate terminal with said other power supply terminal through a human body resistor to reduce said input level at said gate terminal, said human body resistor when so connected being in parallel with said filter capacitor;

said touch sensitive electrode means including;

a first electrode comprising a conductive watch casing for engaging the body skin of a wearer and conductively connected to said gate terminal, said casing including a crystal isolated from the body skin of a wearer, and a second electrode comprising a transparent conductive coating on said crystal electrically isolated from said conductive casing and selectively connected thereto through the body resistance to wearer by engagement with the skin of said wearer.

6. The invention defined in claim 5, wherein said resistance means has a value on the order of $20\times10^6$ ohms and is approximately four times as great as the maximum anticipated value of said human body resistor.

7. A touch-sensitive electronic switching circuit for an electronic wristwatch comprising:

a C-MOS inverter circuit having a gate terminal, two power supply terminals, and an output terminal;

a power source connected across said power supply terminals;

resistance means connected between said gate terminal and one of said supply terminals for maintaining the input level at said gate at approximately the same potential level of said one supply terminal;

touch-sensitive electrode means for connecting said gate terminal with said other power supply terminal through a human body resistor to reduce said input level at said gate terminal; and monostable multivibrator means interconnected with said output terminal of said C-MOS inverter means to provide a display control output signal in response to said redution in said input level at said gate terminals;

said touch-sensitive electrode means including;

a first electrode comprising a conductive watch casing for engaging the body skin of a wearer and conductively connected to said gate terminal, said casing including a cyrstal isolated from the body skin of a wearer, and a second electrode comprising a transparent conductive coating on said crystal electrically isolated from said conductive casing and selectively connected thereto through the body resistance to wearer by engagement with the skin of said wearer.

* * * * *